US007024715B2

(12) United States Patent
Hefti et al.

(10) Patent No.: US 7,024,715 B2
(45) Date of Patent: Apr. 11, 2006

(54) CORK SCREW PROVIDED WITH A CAP CUTTER WHICH CAN BE INSERTED IN THE HANDLE

(75) Inventors: Rolf Hefti, Cugnasco (CH); Walter Ruffner, Maienfeld (CH)

(73) Assignee: Heftitec SA, Cugnasco (CH)

( * ) Notice: Subject to any disclaimer, the term of this patent is extended or adjusted under 35 U.S.C. 154(b) by 0 days.

(21) Appl. No.: 10/959,424

(22) Filed: Oct. 7, 2004

(65) Prior Publication Data

US 2005/0050643 A1 Mar. 10, 2005

Related U.S. Application Data

(63) Continuation of application No. PCT/CH03/00238, filed on Apr. 10, 2003.

(30) Foreign Application Priority Data

Apr. 12, 2002 (CH) ..... 0617/02

(51) Int. Cl.
*B67B 7/44* (2006.01)

(52) U.S. Cl. ..... 7/156; 81/3.45

(58) Field of Classification Search ..... 81/3.45, 81/3.48; 7/155, 156
See application file for complete search history.

(56) References Cited

U.S. PATENT DOCUMENTS

| | | | | | |
|---|---|---|---|---|---|
| 4,703,673 | A | * | 11/1987 | Allen | 81/3.29 |
| 4,727,779 | A | * | 3/1988 | Lee | 81/3.37 |
| 5,351,579 | A | * | 10/1994 | Metz et al. | 81/3.2 |
| D364,324 | S | * | 11/1995 | Entwistle | D8/42 |
| 5,799,551 | A | * | 9/1998 | Vitrac | 81/3.09 |
| D404,987 | S | * | 2/1999 | Larimer | D8/38 |
| 5,887,305 | A | * | 3/1999 | Cellini | 7/155 |
| 6,151,992 | A | * | 11/2000 | Larimer | 81/3.29 |
| 6,196,086 | B1 | * | 3/2001 | Gort-Barten | 81/3.09 |
| 6,431,028 | B1 | * | 8/2002 | So | 81/3.29 |
| 6,732,392 | B1 | * | 5/2004 | Kay | 7/158 |
| 6,739,215 | B1 | * | 5/2004 | Lozeau et al. | 81/3.09 |

FOREIGN PATENT DOCUMENTS

| | | | |
|---|---|---|---|
| DE | 839 319 | | 5/1952 |
| DE | 4326582 | A1 * | 2/1995 |
| FR | 739 784 | | 1/1933 |
| WO | WO 01/30684 | A1 | 5/2001 |

* cited by examiner

*Primary Examiner*—David B. Thomas
(74) *Attorney, Agent, or Firm*—Buchanan Ingersoll PC

(57) ABSTRACT

A bottle opener is disclosed with a corkscrew and a cap cutter, which can be used separately from the corkscrew, wherein the corkscrew can also be used when the cap cutter is arranged on the corkscrew.

12 Claims, 3 Drawing Sheets

CORK SCREW PROVIDED WITH A CAP CUTTER WHICH CAN BE INSERTED IN THE HANDLE

CROSS REFERENCE TO RELATED APPLICATIONS

This application claims priority under 35 U.S.C. §119 to Swiss Application 617/02 filed in Switzerland on 12 Apr. 2002, and as a continuation application under 35 U.S.C. §120 to PCT/CH03/00238 filed as an International Application on 10 Apr. 2003 designating the U.S., the entire contents of which are hereby incorporated by reference in their entireties.

BACKGROUND

The invention relates to a bottle opener. The bottle opener is comprised of a corkscrew with a rotatable handle and an axial screw, anchored in the rotatable handle, which can be screwed into a cork, and a cap cutter, which can be used separately from the corkscrew.

Various bottle openers are known, wherein a corkscrew is equipped with a cutter for cutting caps. The advantage of these bottle openers is that the cap cutter formed on the corkscrew is always available together with it. But it is disadvantageous that for cutting the cap, the entire corkscrew must be picked up and its cutter must be guided around the bottle. Moreover, with these bottle openers there is only one cutter provided, so that such a corkscrew must be guided over 360 degrees around the neck of the bottle in order to completely cut off the cap.

There are also bottle openers with a corkscrew and a cap cutter provided with it, which can be used separately from the corkscrew. The advantage of such a set is that the cap cutter is a small, handy part, which can be used separately from the corkscrew and with preferably more than one cutter. Thanks to the plurality of cutters, the required angle of rotation for cutting the cap all around is as small as possible. However, these sets have the disadvantage that the cap cutter and the corkscrew like to go their separate ways, so that both parts are not necessarily available to the user in case of need. To prevent this, holders for inserting the corkscrew and the cap cutter are made available, for example.

A self-extracting corkscrew is known from U.S. Pat. No. 6,151,992, which has a guide element for supporting a screw element on the neck of the bottle, and a screw element with a screw fastened on a rotatable handle, which can be introduced into the guide element from above. The rotatable handle has end sections which can be flipped over. With the end section flipped down, the screw element can be inserted from below into the guide element, so that the tip of the screw is protected by the upper end of the guide element for storing the corkscrew. A cap cutter is embodied in the guide element. For using the cap cutter, the screw element must be removed from the guide element.

In connection with this corkscrew it is disadvantageous that it is necessary to remove the screw element from the corkscrew for using the cap cutter. Moreover, the cap cutter is only equipped with two oppositely located blades and therefore must be rotated over at least 180 degrees. Also, in comparison with cutting wheels, a worse cutting result must be expected with blades.

A cap cutter in combination with a corkscrew is known from U.S. Pat. No. 6,196,086. The cap cutter is designed to be ring-shaped, with a through-opening through the ring.

The corkscrew can be separated from the cap cutter and has two arms, which can be pivoted toward and away from each other. These arms run together at their lower ends and are designed in such a way that their lower ends fit into the through-opening of the cap cutter. In this case the cap cutter is used as a base, which can keep the corkscrew in an upright position. The cap cutter is equipped with two cutting wheels. In one embodiment, an additional guide wheel is also provided. The wheels enclose identical angles between each other.

It is disadvantageous with this set that, for using the corkscrew, the cap cutter must be separated from the corkscrew. Moreover, for cutting the cap all around, the cap cutter must be rotated over at least 180 degrees.

Finally, a chargeable electrical corkscrew is known from U.S. Pat. No. 5,351,579. It has a drive mechanism which can be switched between forward and reverse. A chargeable energy source and the drive mechanism are housed in one body. A corkscrew driven by the drive mechanism protrudes axially from the body. An envelope element has a first end, into which the body can be displaceably inserted, and a second end divided into two arms and constituting a stop which can work together with an opening of a bottle. A C-shaped cap cutter can be inserted between these arms. The cap cutter is equipped with three cutting wheels.

It is disadvantageous in connection with this corkscrew that it is necessary to remove the cap cutter from the corkscrew for being able to use the corkscrew.

SUMMARY

A bottle opener is disclosed with a corkscrew and a cap cutter, which can be used separately from the corkscrew, wherein the corkscrew can also be used when the cap cutter is arranged on the corkscrew.

With the bottle opener mentioned at the outset, the cap cutter can be put together with the corkscrew for storing it. Therefore the cap cutter and the corkscrew can be releasably connected with each other. On the one hand, this assures that the cap cutter and the corkscrew can be stored together, taken out and made ready for use, but on the other hand also that the cap can be cut by means of an element which is separate from the corkscrew.

The cap cutter is arranged at the rotatable handle. Thanks to the arrangement of the cap cutter at the rotatable handle it is not necessary to remove it for operating the corkscrew. It instead complements the rotatable handle. This has the advantage that in connection with bottles without caps the cap cutter can remain in place and therefore does not become lost. This solution can moreover also be used in connection with corkscrews which do not have a distancing element and are therefore not self-extracting.

A hollow space, accessible from the exterior, is advantageously provided in the rotatable handle. The cap cutter can then be inserted into this hollow space and can be taken out of this hollow space. A clamping connection or a snap-in connection can be advantageously provided between the cap cutter and the corkscrew. This offers the advantage that the two elements can be put together and cannot be inadvertently released from each other.

The hollow space is advantageously embodied in a U-shape around a central fastening block for the screw. The cap cutter itself then has a cutout in accordance with this U-shape, in which the fastening block is placed. This permits a space-saving arrangement of the cap cutter in the rotatable handle of the corkscrew.

If the cap cutter can be introduced into the hollow space in a plane containing the axis of the screw, the cap cutter can be a part of a gripping wing of the rotatable handle, so that the existing volume of the rotatable handle is optimally used.

Advantageously, the cap cutter is U-shaped. Because of this it fits the hollow space with the centrally arranged fastening block. The cap cutter can have at least one cutting head on at least one leg of the U-shape. Advantageously, two, three or four cutting heads can be provided. These can be distributed to both legs. The connector of the U can be advantageously embodied to be elastic. Now, if the cap cutter has facing gripping faces at both legs of the U, the cutting heads provided on the legs can be conducted against the cap by pressure on the gripping faces. The cap can be cut all around by means of a rotation of the cap cutter by approximately 90, 120 or 180 degrees depending on the number and arrangement of the cutting heads.

The rotatable handle advantageously has two substantially parallel walls, which are approximately parallel in relation to a plane containing the screw axis. This can be very easily produced from a plastic material. The hollow space for receiving the cap cutter is advantageously embodied between these walls. In the course of rotating the rotatable handle, these walls usefully constitute engagement faces for the fingers of the user of the corkscrew. Thus, gripping wings are formed by these walls and the cap cutter installed therein.

In a known manner, advantageous corkscrews can have a distancing housing. This is used for transmitting the traction forces, which in the course of removing the cork from a bottle act from the screw toward the rotatable handle, and on the bottle in the form of pressure forces. In this connection the rotatable handle, together with the screw, can advantageously be displaced in relation to the distancing housing in the axial direction of the screw. This makes possible the formation of an area of ribs, which can be pressed into the cork, between a seating surface for transmitting the pressure forces from the distancing housing to the bottle and the rotatable handle in the distancing housing. In this area the cork can be secured against rotation by means of these ribs, and the screw can be turned out of the cork in this way.

BRIEF DESCRIPTION OF THE DRAWINGS

An advantageous exemplary embodiment will be described by way of the drawing figures. Shown are in.

DETAILED DESCRIPTION

Figure 1:
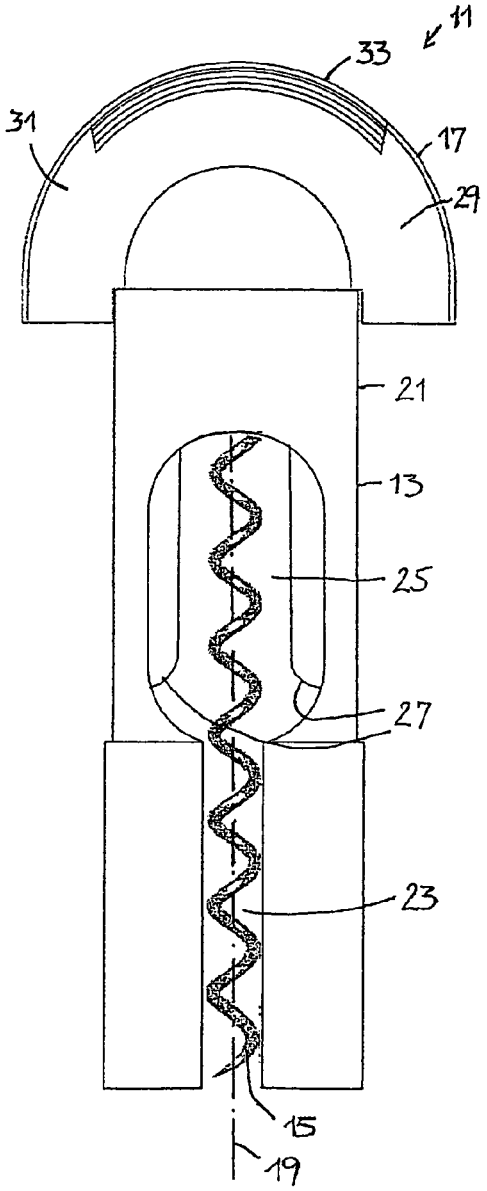
FIG. 1, a plan view of a bottle opener in accordance with an exemplary embodiment of the invention.
Figure 2:
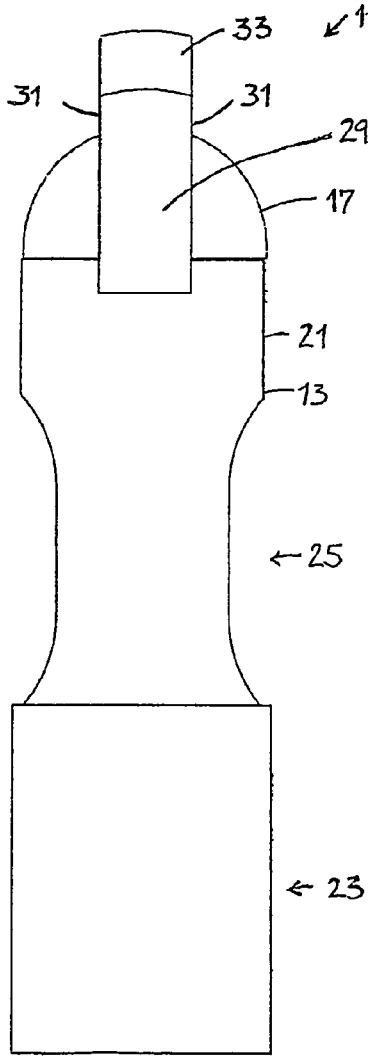
FIG. 2, a lateral view of the bottle opener in FIG. 1.
Figure 3:
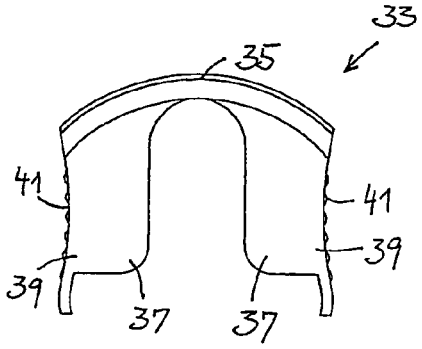
FIG. 3, a plan view of an exemplary cap cutter, such as is integrated into the rotatable handle of the bottle opener in accordance with FIGS. 1 and 2.
Figure 4:
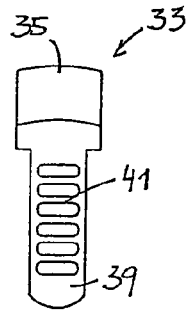
FIG. 4, a lateral view of the cap cutter in FIG. 3.
Figure 5:
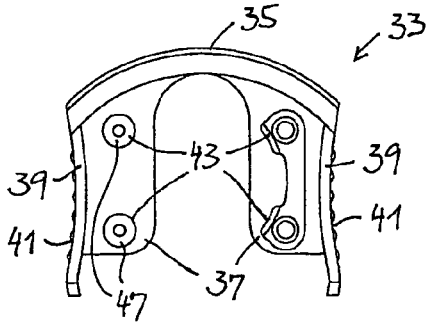
FIG. 5, a plan view of the cutting head side of the cap cutter in FIGS. 3 and 4.
Figure 6:
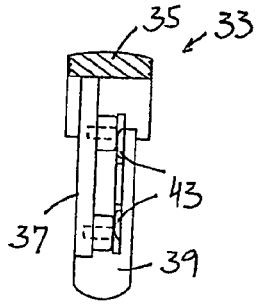
FIG. 6, a section along the line X—X through the bottle opener in FIGS. 3 to 5.
Figure 7:
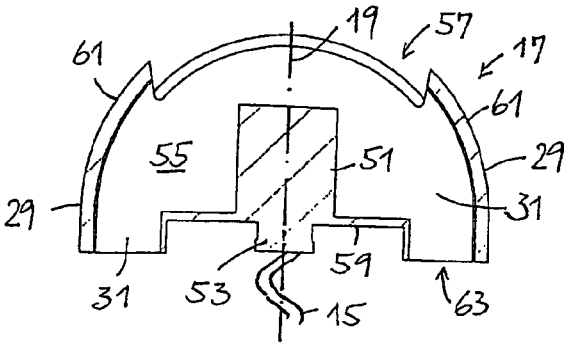
FIG. 7, a vertical section through the rotatable handle of the bottle opener in FIGS. 1 and 2.
Figure 8:
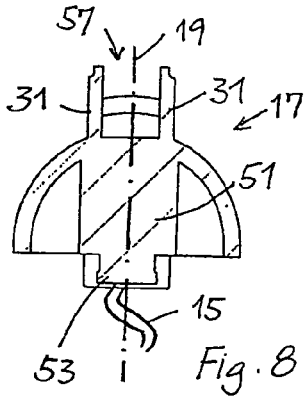
FIG. 8, a vertical cross section through the rotatable handle in FIG. 7.
Figure 9:
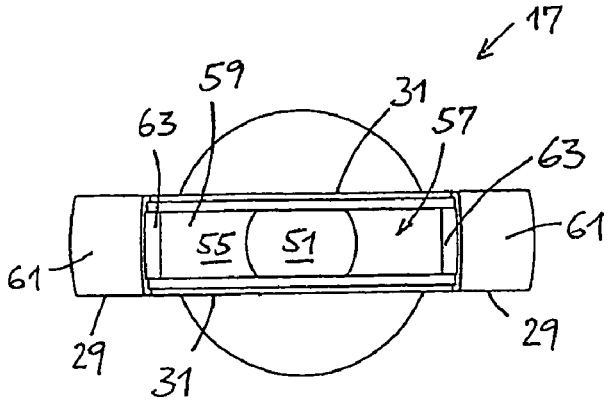
FIG. 9, a view from above on the rotatable handle in FIGS. 7 and 8.
Figure 10:
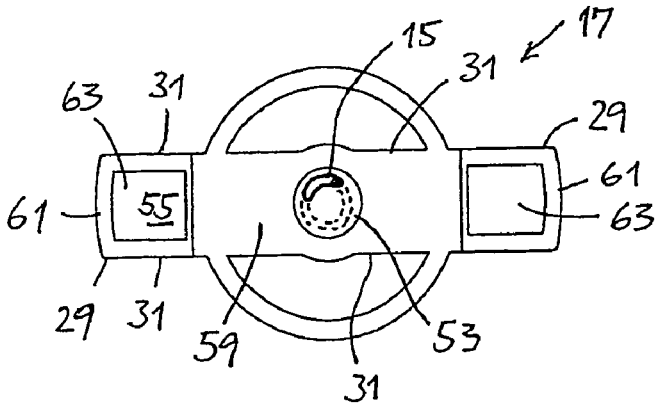
FIG. 10, a view from below on the rotatable handle in FIG. 9.

The exemplary bottle opener 11 represented in FIGS. 1 and 2 is a corkscrew. For extracting corks, the corkscrew 13 has a screw 15 made of wound wire. The screw 15 is covered with a plastic coating for improving the sliding ability of the screw in the cork. The screw 15 is anchored in a rotatable handle 17. The rotatable handle 17 is seated, rotatable around the screw axis 19, on a distancing element 21. In a known manner, the distancing element 21 can have two areas: a lower area 23 for being placed on a neck of a bottle. By means of this the force occurring in the course of extracting the cork is transmitted to the neck of the bottle in the form of a pressure force. In an upper area 25, the extracted cork can be secured against rotation around the screw axis. To this end, two ribs 27 have been formed on the distancing element 21 in a plane including the screw axis 19.

The rotatable handle 17 can be clipped to the distancing element 21. It can be released from the distancing element 21 by pulling. By means of this a screwed-in cork can be pulled entirely into the upper area 25 and held there. In this position the screw 15 can be turned out of the cork.

The rotatable handle 17 has gripping wings 29, to which the force to be applied to the screw 15 can be comfortably applied. These gripping wings consist essentially of two parallel walls 31, which are partially connected. A cap cutter 33 has been pushed between these walls 31. Cutouts are provided in the walls 31, which are complemented by the cap cutter 33.

The cap cutter 33 is represented in FIGS. 3 to 6. The cap cutter 33 has a U-shaped basic shape. It has an elastic connector 35 and two legs 39 stiffened by means of transverse ribs 37. Gripping faces 41 are formed on the legs 39. The connector 35 can be bent by applying pressure to the oppositely located pressure faces 41. The two legs 39 can be brought closer to each other in this way.

The stiffening ribs 37 are arranged on one side of the legs 39. The gripping faces 41 are embodied so that they project past the stiffening ribs 37 on one side. Cutting heads 43 project away from the stiffening ribs 37 on the same side on which the gripping faces 41 project. Each of the cutting heads 43 can be embodied with a cutter 45 or with a cutting disk 47, which rolls off in the course of cutting. It is possible to embody two oppositely located cutting heads 43, three, or also, as represented, four cutting heads 43.

This cap cutter 33 can be inserted into the rotatable handle 17 represented in FIGS. 7 to 10. To this end, the rotatable handle 17 is designed as a hollow element. A fastening block 51 is embodied in the rotatable handle 17, into which the screw 15 has been inserted by casting. A cylindrical seating body 53 is embodied on the fastening block 51 and can be snapped into a corresponding depression in the distancing element 21. The screw 15 extends from the fastening block 51 at the front face of this seating body 53.

The fastening block 51 is connected with two walls 31, which together form the gripping wings 29. The walls 31 are partially connected with each other for their sufficient stiffening. The hollow space 55 between the walls 51 is partially open toward the top and partially open toward the bottom. An upper opening 57 exists centrally and extending over the fastening block 51, into which the cap cutter 33 can be inserted. In this area the walls 31 are connected by the fastening block 51 and a bottom 59 arranged opposite the upper opening 57. The two walls are connected by a covering surface 61 next to the upper opening 57. This area of the walls 31, which is connected with the covering surface 61, projects past the cylindrical contour outline of the distancing element 21. In these projecting parts the hollow space 55 is open toward the bottom. These lower openings 63 can overlap the upper opening 57, so that the rotatable handle can be produced in the form of a plastic element.

A half-shell is formed on these walls 31, which is used to provide the distancing element 21 with a termination pleasing to the eye. At the same time, this half-shell constitutes a stiffening of the two walls 31. The half-shell encloses a hollow space open toward the bottom.

Figure 11:
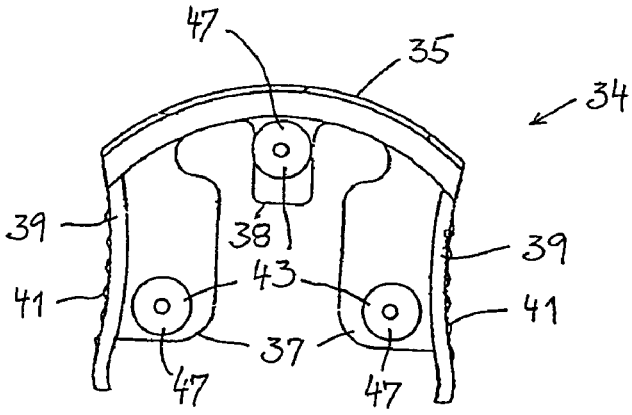
FIG. 11, a plan view of the cutting head side of a second exemplary embodiment of a cap cutter with only three cutting heads.

A cap cutter 34 with three rolling cutting disks 47 is represented in FIG. 11. It is identical to a large extent with the cap cutter 33 in accordance with FIGS. 3 to 6. However, in contrast to the latter the cap cutter 34 has only one cutting disk 47 on each transverse rib 37 of the two legs 39. A third cutting disk is arranged in the plane of symmetry of the cap cutter at a further rib 38. The rib 38 is located in the same plane as the transverse ribs 37 and has been formed on the connector 35. A place in the connector 35, which is not stiffened by a transverse rib 37, has been formed on both sides of this rib 38, so that the connector 35 can resiliently yield at these places when the legs 39 are pressed against each other.

Stated in summary, a cap cutter 33 is integrated into a corkscrew 13 in such a way that, for turning the screw 15 into the cork, it can be inserted into the rotatable handle 17, and can be released from the corkscrew 13 for cutting a cap.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A bottle opener, comprising:

a corkscrew, the corkscrew including an axial screw configured to rotate for screwing into a cork, and a handle for rotating the screw, the screw being anchored in the handle, and the handle having a hollow space accessible from an exterior; and a cap cutter, the cap cutter being connectable with the corkscrew for storage by introducing the cap cutter into the hollow space in the handle, and the cap cutter being separable from the corkscrew by removing said cap cutter from said hollow space, wherein the hollow space is embodied in a U-shape around a central fastening block for the screw, and the cap cutter has a cutout corresponding to this U-shape, in which the fastening block is placed.

2. The bottle opener in accordance with claim 1, wherein the cap cutter is configured to be introduced into the hollow space in a plane, which contains the axis of the screw.

3. The bottle opener in accordance with claim 1, wherein the rotatable handle has two essentially parallel walls, which are parallel in respect to a plane containing the screw axis, and the hollow space is embodied between these walls.

4. A bottle opener, comprising:

a corkscrew, the corkscrew including an axial screw configured to rotate for screwing into a cork, and a handle for rotating the screw, the screw being anchored in the handle, and the handle having a hollow space accessible from an exterior; and a cap cutter, the cap cutter being connectable with the corkscrew for storage by introducing the cap cutter into the hollow space in the handle, and the cap cutter being separable from the corkscrew by removing said cap cutter from said hollow space, wherein the rotatable handle has two essentially parallel walls, which are parallel in respect to a plane containing the screw axis, and the hollow space is embodied between these walls.

5. The bottle opener in accordance with claim 4, wherein the hollow space is embodied in a U-shape around a central fastening block for the screw, and the cap cutter has a cutout corresponding to this U-shape, in which the fastening block is placed.

6. A bottle opener, comprising:

a corkscrew, the corkscrew including an axial screw configured to rotate for screwing into a cork, and a handle for rotating the screw, the screw being anchored in the handle, and the handle having a hollow space accessible from an exterior; and a cap cutter, the cap cutter being connectable with the corkscrew for storage by introducing the cap cutter into the hollow space in the handle, and the cap cutter being separable from the corkscrew by removing said cap cutter from said hollow space.

7. The bottle opener in accordance with claim 6, wherein the cap cutter is U-shaped and has at least one cutting head on at least one leg of the U.

8. The bottle opener in accordance with claim 7, wherein the cap cutter has oppositely located gripping faces on each leg of the U, and a connector of the U is elastic.

9. The bottle opener of claim 7, wherein the cap cutter is U-shaped and has two cutting heads on each leg of the U-shape.

10. The bottle opener in accordance with claim 6, wherein the rotatable handle is a hollow body made of a plastic material.

11. The bottle opener in accordance with claim 6, comprising:

a distancing housing configured for transmitting traction forces, which act from the screw to the rotatable handle, toward a bottle from which the cork is to be removed, as pressure forces when extracting a cork from a bottle.

12. The bottle opener in accordance with claim 11, wherein the screw and the rotatable handle are configured to be displaced in relation to the distancing housing in an axial direction of the screw, and comprising:

an area with ribs, configured to be pressed into a cork, embodied in the distancing housing between a seating surface for transmitting pressure forces from the distancing housing to a bottle and the rotatable handle, in which the cork can be secured against rotation by the ribs.

* * * * *